US005575700A

United States Patent [19]

Cohen

[11] Patent Number: 5,575,700

[45] Date of Patent: Nov. 19, 1996

[54] LANDING GEAR FOR MODEL AIRPLANES

[76] Inventor: Allen J. Cohen, 110 Goodale St., Peabody, Mass. 01960

[21] Appl. No.: 436,848

[22] Filed: May 8, 1995

[51] Int. Cl.[6] ..... A63H 27/90; A63H 17/26

[52] U.S. Cl. ..... 446/34; 446/55; 446/466; 244/50; 244/104.05

[58] Field of Search ..... 446/30, 31, 32, 446/33, 34, 35, 51, 57, 58, 59, 60, 61, 429, 466; 244/50, 190, 104 CS, 104 R

[56] References Cited

U.S. PATENT DOCUMENTS

| | | | |
|---|---|---|---|
| 1,812,143 | 6/1931 | Dugan | 244/104 CS |
| 2,347,689 | 5/1944 | Johnson | 446/57 |
| 2,551,410 | 5/1951 | Andemar | 244/104 R X |
| 2,913,865 | 12/1959 | Bergstrand | 446/34 |
| 3,940,882 | 3/1976 | Mabuchi | 446/58 |
| 4,948,069 | 8/1990 | Veaux et al. | 244/50 |

FOREIGN PATENT DOCUMENTS

| | | | |
|---|---|---|---|
| 2415993 | 4/1974 | Germany | 446/34 |
| 3934839 | 4/1991 | Germany | 446/34 |

OTHER PUBLICATIONS

American Modeler, Feb. 1959, p. 37.

*Primary Examiner*—Robert A. Hafer
*Assistant Examiner*—D. Neal Muir

[57] ABSTRACT

The invention is directed to landing gears for model airplanes. Both the nosegear and the main landing gear are constructed by using an in-line structure having an axial coil spring which is connected to the airplane structure by a shank. The shank is configured to be in-line and generally coaxial with axial coil spring.

2 Claims, 2 Drawing Sheets

LANDING GEAR FOR MODEL AIRPLANES

The invention is directed to landing gears for model airplanes.

In accordance with the most common construction of nose landing wheels, in particular, the landing gear assembly contains a coil spring defined about a horizontal axis. One end of the coil contains a vertical member for joining the gear to the model airplane, generally a bulkhead. There depends from the coil a landing wheel mounting means containing a horizontal axle for mounting the landing wheel and a transition section for joining the straight length of wire to the axle. The landing gear assembly generally is constructed from a single continuous length of piano wire.

The widely used structure just described is troublesome because the transition section frequently bends when subjected to severe landings. The subsequent procedure for straightening the length of wire forming the transition section is very awkward. Further, in the straightening process the transition section, the firewall, and landing gear mounting surfaces of the airplane are frequently damaged. A bent transition section also causes detrimental "plow landings".

PRIOR ART DISCLOSURE

The structure described above is the closest prior art found. In addition U.S. Pat. Nos., 3,422,567, 3,431,672, 3,739,519, 3,752,421, 3,900,988, 4,718,875, and 5,096,452 were examined. None were found to contain springs.

OBJECTS

It is a general object of the invention to provide a landing gear assembly for model airplanes which avoids the problems and limitations of prior landing gears for model airplanes.

It is another object of the invention to provide an in-line landing gear assembly for model airplanes.

It is another object of the invention to provide landing gear assembly for model airplanes that can withstand 9G landing loads without permanent deformation or breakage of the airplane or landing gear structure.

It is another object of the invention to provide a friction clamp for a steerable landing gear assembly for model planes which can withstand 9G landing loads without slippage.

It is yet another object of the invention to provide a landing gear assembly which may be repeatedly deflected laterally in both rearward and sideward directions up to 70 degrees without permanent deformation.

Other objects and advantages of the invention will become apparent upon reading the following detailed description and upon reference to the drawings. Throughout the description, like reference numerals refer to like parts.

DETAILED DESCRIPTION

Figure 1:
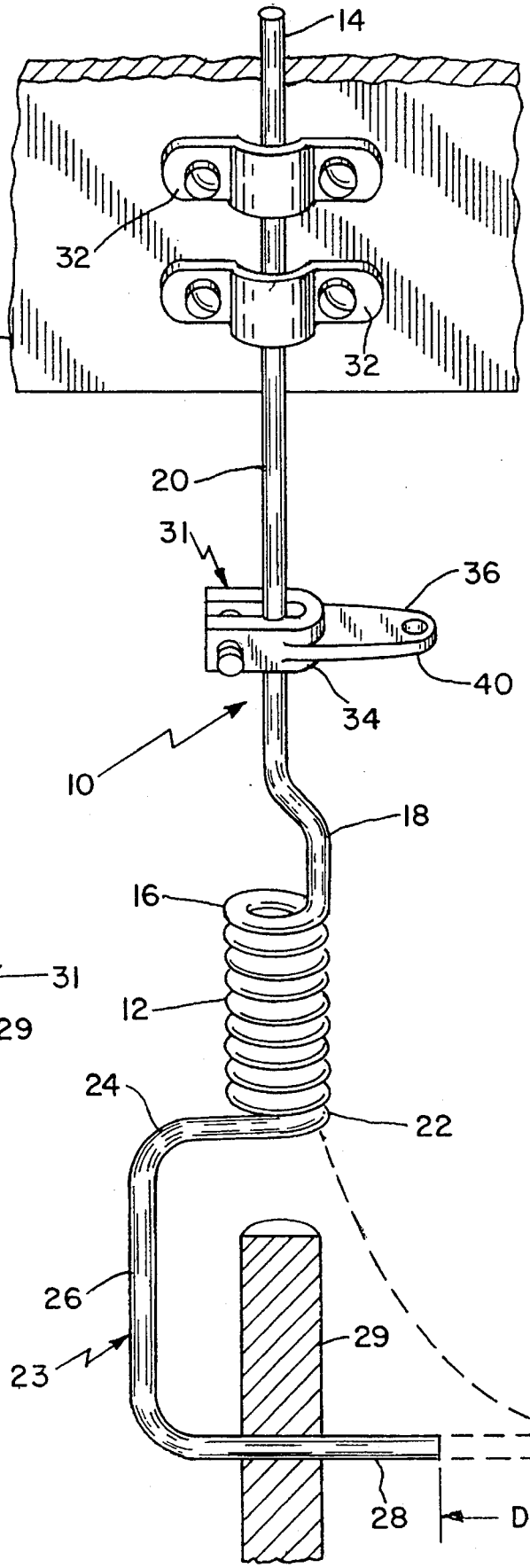
FIG. 1 depicts a nosegear assembly.

Turning first to FIG. 1 there is shown a nose landing gear assembly 10 of the present invention. The landing gear assembly 10 features an in-line construction comprising an axial coiled spring 12 defined about a vertical central axis 14. The spring 12 contains a plurality of coils which in this case are circular. Extending from a top coil 16 is a transition section 18 which couples the spring 12 to a shank 20 which rises vertically above the spring 12 and is coaxial with the spring 12.

Depending from a bottom coil 22 is a landing wheel mounting means 23 which comprises a horizontal extension 24 of the bottom coil 22 joined to a downwardly directed transition section 26. The section 26 terminates in an axle 28. The axle 28 extends horizontally to provide support for a landing wheel 29.

The nose landing gear assembly 10 in FIG. 1 is shown mounted on a firewall 30 of a model airplane by means of a brackets 32, or other suitable means including the holes that are sometimes provided in molded engine mounts for shanks. Brackets 32 will include a sleeve bearing—not shown—through which the shank 20 passes in the event the nosegear assembly 10 is intended to be steerable.

Figure 2:
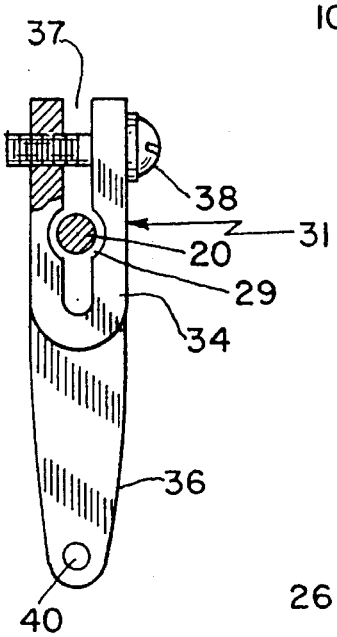
FIG. 2 shows a friction clamp for linking the nosegear to a steering mechanism.

Means for rotating the nosegear assembly 10 is a friction clamp 31 which resembles a tuning fork having a yoke 34 shown in detail in FIG. 2 and an arm 36. The yoke 34 includes an elongated slot 37 with screw 38 passing through the slot 37 near the terminal end of the yoke into a threaded hole. There is also defined in the yoke 34 a passage 39 which is generally circular in section. The passage 39 is dimensioned to accept the shank 20 and to frictionally engage the perimeter, in this case the circumference, of the shank 20 when the width of the channel 37 is narrowed when the screw is tighened.

The arm 36 contains a passage 40 through which the steering mechanism of the airplane can pass. Lateral movement of the arm 36 is translated into rotary movement for the shank 20 and therefore for the nosegear assembly 10.

Conventional steering mechanisms using a similar steering bracket use a pointed set screw, which because of the point contact tends permit the rotation of the shank relative to the steering bracket under severe landing conditions thus upsetting the steering calibrations. The passage 39 is designed to frictionally engage a 270 degree area of the shank 20 circumference. 270 degrees of friction contact will not enable the shank 20 to move relative to the passage 29 under severe landing conditions.

The preferred construction is to form the nosegear 10 from a single bar of wire as shown in FIG. 1. When using a 5/32 diameter "music wire" bars the spring exhibits a spring constant of ½ inch per 15.5 lbs. of lateral force. The spring constant was observed by moving the axle laterally until the deflection "D" in FIG. 1. of the axle was ½.

In this example the axle was 2 inches from the bottom of the spring. The spring had an outside diameter of 11/16 inches and was 2⅜ inches long and the shank was 2 inches long.

Clearly, the spring dimensions may vary with the size and weight of the airplane on which it is to be placed. The dimensions and characteristics of the landing gear assembly 10 can also be varied to accommodate varying wheel dimensions.

Nosegear with the above described characteristics functioned well with airplanes having a variety of configurations and weight.

Figure 3:
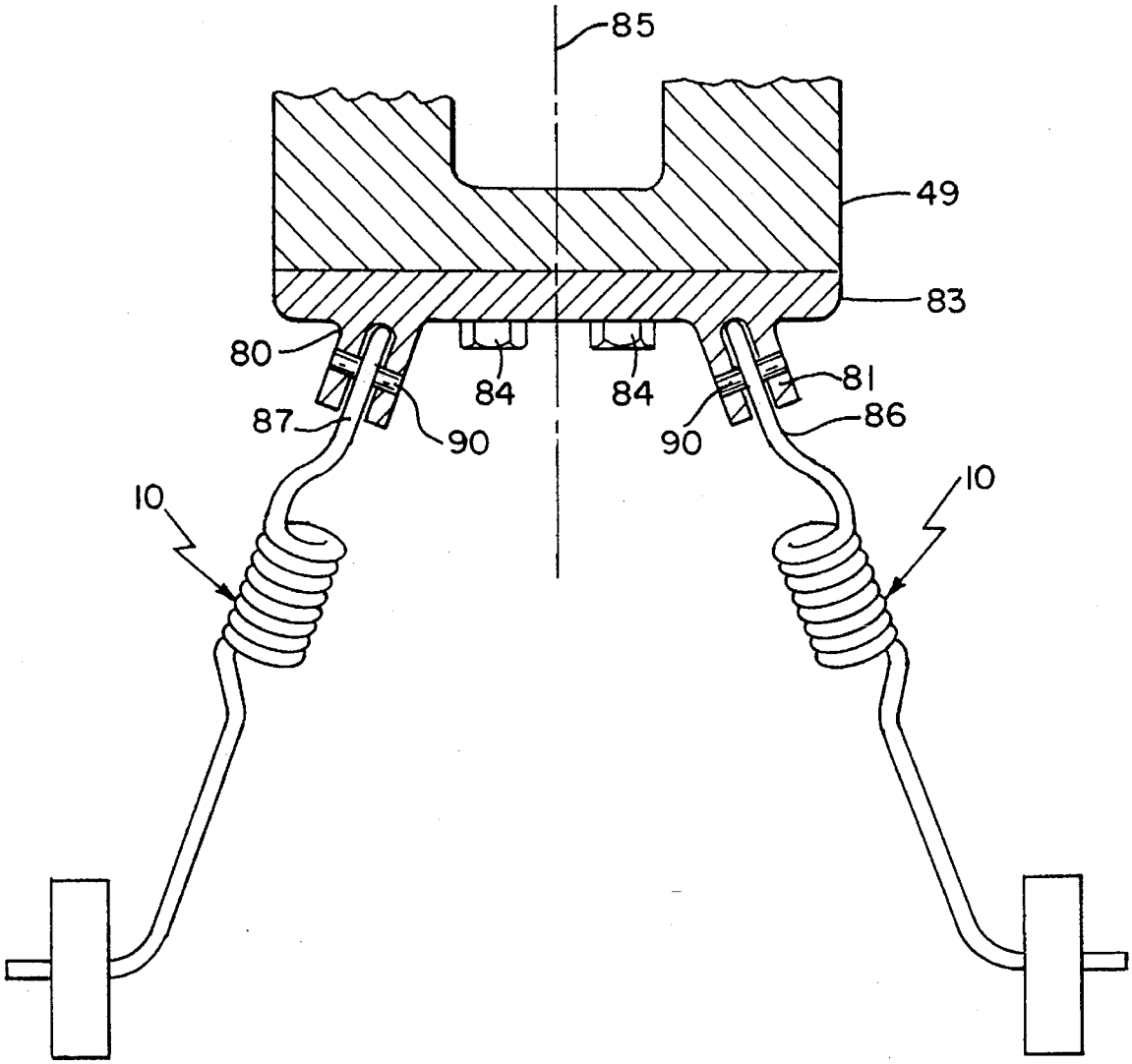
FIG. 3 shows an alternate main landing gear assembly utilizing the in-line landing gear assembly depicted in FIG. 1.

An alternate main landing gear construction is shown in FIG. 3. A flat plate 83 is fastened to the bottom of the airplane structure 49 by a plurality of screws 84 to prevent the plate 83 from being rotated relative to the axis 85. There are defined either integrally, or attached by means of solder or welds a pair of spaced apart sleeves 80 and 81, An in-line landing gear assembly 10 containing shanks 86 or 87 depends from the plate 83. The shank of each landing gear assembly is positioned in one of the sleeves 80 or 87 and each is held in position by a pin 90.

The several landing gears described above provide shock absorbing action. They have the added virtue of being capable of being bent laterally up to 70 degrees without permanent deformation. This latter property eliminates the dangerous re-bending required of the conventional landing gears. It also avoids damage to the firewall and gear mounting surfaces.

The ability to return to vertical attitude reduces "plow landings" enabling the engine to keep running for taxi and take-off.

While the invention will be described in the preferred embodiment, it is understood that the invention is not to be limited to the preferred embodiment. On the contrary, it is intended to cover all alternatives, modifications, and equivalents as be included within the spirit and scope of the invention.

I claim:

1. A landing gear assembly for model airplanes with means for mounting the landing gear assembly to the model plane consisting essentially of:

a single spring wire forming a coil spring about a central axis, said coil spring having a plurality of coils including a bottom coil and a top coil;

a length of said wire depending from said bottom coil and configured to define a wheel mounting means;

a length of said wire extending from the top coil essentially coaxial with said central axis thereby defining a mounting shank; and a model aircraft wheel mounted on said wheel mounting means.

2. A wire spring steerable nose gear assembly for model airplanes having a steering mechanism comprising:

an axial coil spring made of wire defined about a central axis and having a top coil and a bottom coil:

bracket means for mounting the landing gear assembly to a model airplane, said bracket means including a bearing;

said top coil extended to form a length of said wire essentially coaxial with said central axis thereby defining a mounting shank, said mounting shank for being positioned in said bracket means and for rotatably attaching the steerable nose gear assembly to a model airplane, said shank having a perimeter;

said bottom coil extended to form a length of said wire configured to define a wheel mounting means;

a model aircraft wheel mounted on said wheel mounting means; and a friction clamp engaging the perimeter of said shank for attaching said shank to a steering mechanism of a model airplane for rotating the shank, spring and wheel about the central axis.

* * * * *